US011652311B2

(12) United States Patent
Zhang et al.

(10) Patent No.: US 11,652,311 B2
(45) Date of Patent: May 16, 2023

(54) CONNECTOR ASSEMBLY

(71) Applicant: Tyco Electronics (Shanghai) Co. Ltd., Shanghai (CN)

(72) Inventors: Wei Zhang, Shanghai (CN); Ming Shi, Shanghai (CN); Xiaozhi Fu, Shanghai (CN); Dingbing Fan, Shanghai (CN); Shuzhi Wang, Shanghai (CN); Hongtao Jiang, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 26 days.

(21) Appl. No.: 17/123,339

(22) Filed: Dec. 16, 2020

(65) Prior Publication Data

US 2021/0194166 A1 Jun. 24, 2021

(30) Foreign Application Priority Data

Dec. 20, 2019 (CN) ..... 201922311332.2

(51) Int. Cl.

| | |
|---|---|
| ***H01R 13/11*** | (2006.01) |
| ***H01R 13/627*** | (2006.01) |
| ***H01R 13/05*** | (2006.01) |
| ***H01R 13/50*** | (2006.01) |
| ***H01R 4/2416*** | (2018.01) |

(52) U.S. Cl.

CPC ..... *H01R 13/113* (2013.01); *H01R 13/05* (2013.01); *H01R 13/112* (2013.01); *H01R 13/50* (2013.01); *H01R 13/6272* (2013.01); *H01R 4/2416* (2013.01)

(58) Field of Classification Search

CPC ..... H01R 4/4818; H01R 13/28; H01R 13/26; H01R 2103/00; H01R 13/432; H01R 24/62; H01R 4/4836; H01R 11/05; H01R 13/112; H01R 2107/00; H01R 24/20; H01R 24/28; H01R 11/09; H01R 13/04; H01R 24/84; H01R 13/631; H01R 13/6273; H01R 13/514; H01R 13/506; H01R 13/42; H01R 13/10

See application file for complete search history.

(56) References Cited

U.S. PATENT DOCUMENTS 4,552,425 A * 11/1985 Billman ..... H01R 13/28 439/295
5,807,133 A * 9/1998 Arnett ..... H01R 4/2404 29/866

(Continued)

*Primary Examiner* — Jean F Duverne
(74) *Attorney, Agent, or Firm* — Barley Snyder

(57) ABSTRACT

A connector assembly includes a first connector and a second connector matable with the first connector. The first connector has a first housing and a pair of first conductive terminals disposed in the first housing each having a pair of first elastic terminals arranged symmetrically in a vertical direction. Each pair of first elastic terminals has a pair of front ends adapted to be brought into elastic and electrical contact with a pair of first wires inserted into the first connector. The second connector has a second housing and a pair of second conductive terminals disposed in the second housing each having a rear end adapted to be brought into elastic and electrical contact with a second wire inserted into the second connector. The pair of first elastic terminals each have a rear end adapted to clamp a front end of one of the second conductive terminals.

18 Claims, 3 Drawing Sheets

(56) References Cited

U.S. PATENT DOCUMENTS

| | | | | |
|---|---|---|---|---|
| 7,527,509 | B1 * | 5/2009 | Bethurum | H01R 4/4818 439/153 |
| 7,753,718 | B2 * | 7/2010 | Bethurum | H01R 24/20 439/441 |
| 9,664,197 | B2 * | 5/2017 | Walker | F04D 25/088 |
| 9,716,335 | B2 * | 7/2017 | Shi | H01R 13/50 |
| 9,748,674 | B2 * | 8/2017 | Xu | H01R 4/4836 |
| 9,972,931 | B1 * | 5/2018 | Chen | H01R 13/112 |
| 9,972,953 | B1 * | 5/2018 | Zamora | H01R 13/26 |
| 10,164,383 | B2 * | 12/2018 | Feng | H01R 24/20 |
| 10,615,537 | B2 * | 4/2020 | Shi | H01R 13/514 |
| 10,886,640 | B2 * | 1/2021 | Zhang | H01R 13/26 |
| 11,005,205 | B2 * | 5/2021 | Chen | H01R 13/04 |

* cited by examiner

CONNECTOR ASSEMBLY

CROSS-REFERENCE TO RELATED APPLICATION

This application claims the benefit of the filing date under 35 U.S.C. § 119(a)-(d) of Chinese Patent Application No. 201922311332.2, filed on Dec. 20, 2019.

FIELD OF THE INVENTION

The present invention relates to a connector assembly and, more particularly, to a connector assembly connecting a single first wire with a pair of second wires.

BACKGROUND

A type of connector is adapted to electrically connect a single first wire with two second wires simultaneously. The connector usually comprises a housing and integral conductive terminals provided in the housing. One end of each of the conductive terminals has a single first elastic contact arm, and the other end thereof has two second bifurcated elastic contact arms. The first elastic contact arm of each of the conductive terminals is adapted to be brought into elastic and electrical contact with the single first wire, and the two second elastic contact arms of each of the conductive terminals are adapted to be brought into elastic and electrical contact with two second wires, respectively.

Because the conductive terminals are integrated, the first wire or the second wires must be pulled out from the connector when the first wire needs to be electrically separated from the second wires, which is very inconvenient to use. In addition, because the conductive terminals are integrated, it is difficult to assemble the conductive terminal into the housing, which increases the difficulty and cost of assembling the connector.

SUMMARY

A connector assembly includes a first connector and a second connector matable with the first connector. The first connector has a first housing and a pair of first conductive terminals disposed in the first housing each having a pair of first elastic terminals arranged symmetrically in a vertical direction. Each pair of first elastic terminals has a pair of front ends adapted to be brought into elastic and electrical contact with a pair of first wires inserted into the first connector. The second connector has a second housing and a pair of second conductive terminals disposed in the second housing each having a rear end adapted to be brought into elastic and electrical contact with a second wire inserted into the second connector. The pair of first elastic terminals each have a rear end adapted to clamp a front end of one of the second conductive terminals.

BRIEF DESCRIPTION OF THE DRAWINGS

The invention will now be described by way of example with reference to the accompanying Figures, of which.

DETAILED DESCRIPTION OF THE EMBODIMENTS

Figure 1:
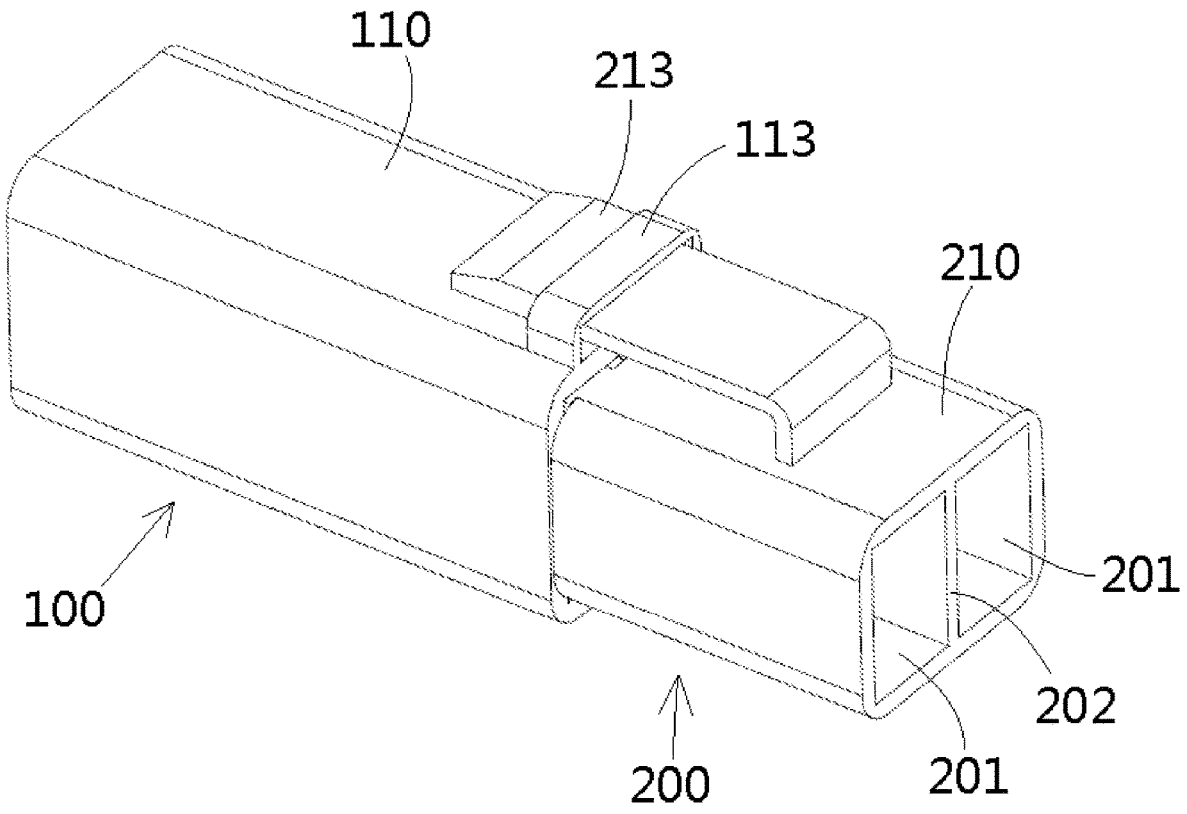
FIG. 1 is a perspective view of a connector assembly according to an embodiment in an assembled state.

The technical solutions of the disclosure will be described hereinafter in further detail with reference to the following embodiments, taken in conjunction with the accompanying drawings. In the description, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

Figure 2:
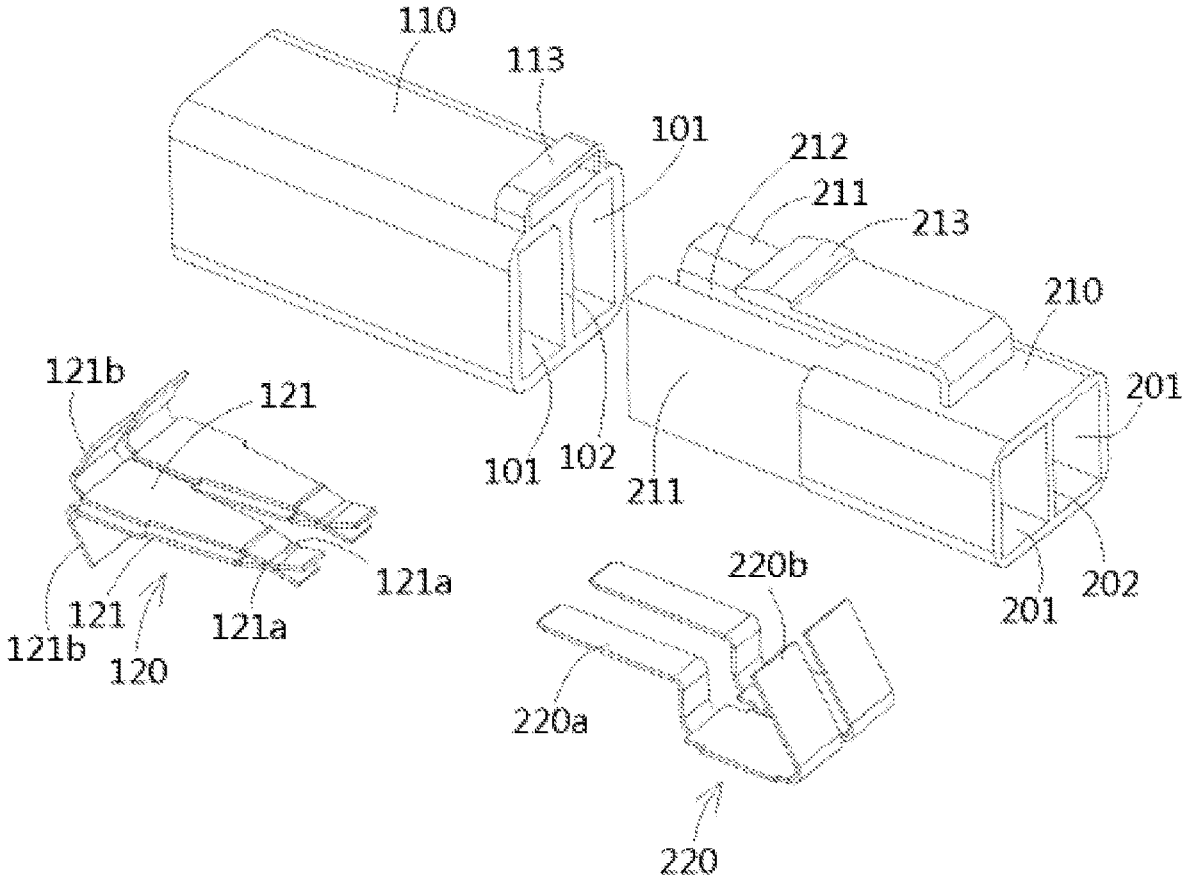
FIG. 2 is an exploded perspective view of the connector assembly.
Figure 3:
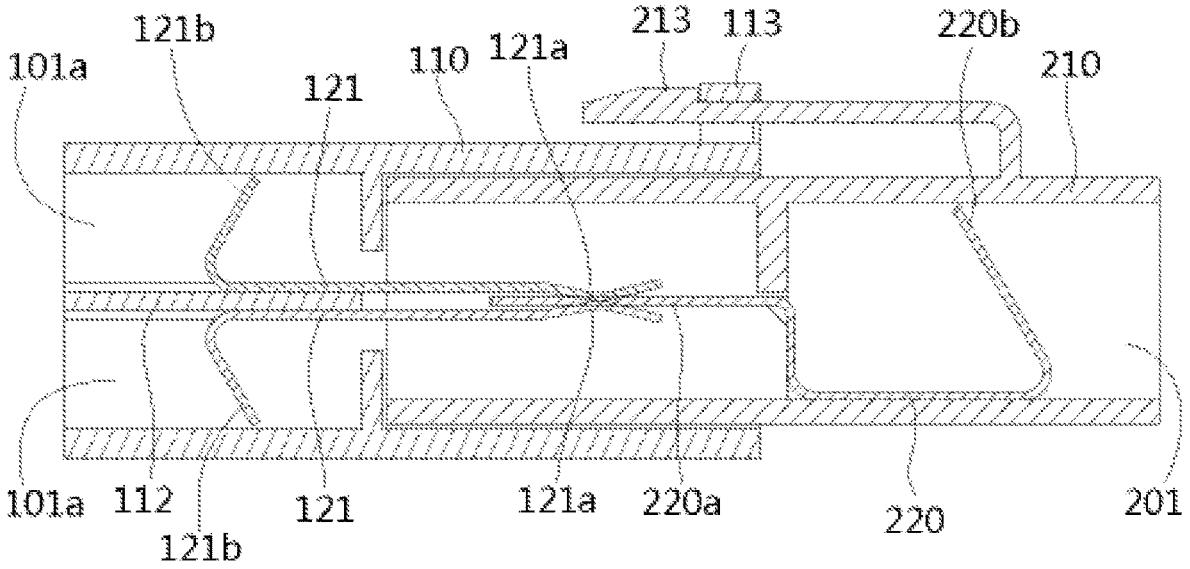
FIG. 3 is a sectional side view of the connector assembly in the assembled state.

A connector assembly according to an embodiment, as shown in FIGS. 1 to 3, comprises a first connector 100 and a second connector 200 adapted to be mated with the first connector 100. The first connector 100 includes a first housing 110 and a pair of first conductive terminals 120 provided in the first housing 110. The second connector 200 includes a second housing 210 and a pair of second conductive terminals 220 provided in the second housing 210.

As shown in FIGS. 1 to 3, in the illustrated embodiments, each of the first conductive terminals 120 has a pair of first elastic terminals 121 arranged symmetrically in a vertical direction. The pair of first elastic terminals 121 has rear ends 121*a* adapted to clamp a front end 220*a* of a corresponding one of the second conductive terminals 220. Front ends 121*b* of the pair of first elastic terminals 121 are adapted to be brought into elastic and electrical contact with two first wires inserted into the first connector 100, respectively. Each of the second conductive terminals 220 has a rear end 220*b* adapted to be brought into elastic and electrical contact with a second wire inserted into the second connector 200.

As shown in FIGS. 1 to 3, in the illustrated embodiments, the first housing 110 has a first vertical partition wall 102 adapted to divide an internal space of the first housing 110 into two first insertion cavities 101 arranged side by side in a horizontal direction. The pair of first conductive terminals 120 are inserted into the two first insertion cavities 101, respectively.

As shown in FIG. 3, in the illustrated embodiment, the first housing 110 has a first horizontal partition wall 112 located in a rear portion of the first housing 110 and adapted to divide a front portion of each of the first insertion cavities 101 into two first receiving chambers 101*a* arranged in the vertical direction. The front ends 121*b* of the pair of first elastic terminals 121 are received in the two first receiving chambers 101*a*, respectively.

The two first wires are inserted into the two first receiving chambers 101*a* and are elastically pressed against inner walls of the two first receiving chambers 101*a* by the front ends 121*b* of the pair of first elastic terminals 121, respectively. The front end 121*b* of each of the first elastic terminals 121 has a piercing edge adapted to pierce into the first wire so that the first elastic terminal 121 is brought into reliable electrical contact with the first wire.

As shown in FIG. 2, in the illustrated embodiment, the second housing 210 is formed, at a front portion thereof, with a vertical positioning groove 212 adapted to cooperate with the first vertical partition wall 102 of the first housing 110. The vertical positioning groove 212 is configured to divide the front portion of the second housing 210 into two plug portions 211 arranged side by side in the horizontal direction. The two plug portions 211 of the second housing 210 are adapted to be inserted into the two first insertion cavities 101 of the first housing 110, respectively, and the first vertical partition wall 102 of the first housing 110 is adapted to be inserted into the vertical positioning groove 212 of the second housing 210.

As shown in FIGS. 1 to 3, in the illustrated embodiments, the second housing 210 has a second vertical partition wall 202 adapted to divide an interior space of a rear portion of the second housing 210 into two second insertion cavities 201 arranged side by side in the horizontal direction. The pair of second conductive terminals 220 are inserted into the two second insertion cavities 201, respectively. The front ends 220*a* of the pair of second conductive terminals 220 are received in the two plug portions 211, respectively. The rear ends 220*b* of the pair of second conductive terminals 220 are received in the two second insertion cavities 201, respectively.

The second wire is inserted into the second insertion cavity 201 and is elastically pressed against the inner wall of the second insertion cavity 201 by the rear end 220*b* of the second conductive terminal 220. The rear end 220*b* of each of the second conductive terminals 220 has a piercing edge adapted to pierce into the second wire so that the second conductive terminal 220 is brought into reliable electrical contact with the second wire.

As shown in FIGS. 1 and 2, in the illustrated embodiments, the front end 220*a* of each of the second conductive terminals 220 is tongue-shaped and adapted to be inserted between the rear ends 121*a* of the pair of first elastic terminals 121. The front end 220*a* of each of the second conductive terminals 220 is clamped by the pair of elastic terminals 121 by elastic deformation forces of the pair of elastic terminals 121.

In the connector assembly according to various embodiments of the disclosure as described, it is possible to quickly realize the connection and separation between a single first wire and a pair of second wires by plugging and unplugging the first connector 100 and the second connector 200, which is very convenient to use.

As shown in FIGS. 1 to 3, in the illustrated embodiments, the first connector 100 is adapted to be mated with the second connector 200 in a pluggable manner. The first housing 110 is adapted to be mated with the second housing 210 in a snap-fit manner. In the illustrated embodiments, a snap ring 113 is formed on one of the first housing 110 and the second housing 210, and an elastic insertion tongue 213 is formed on the other of the first housing 110 and the second housing 210 and is adapted to be inserted into the snap ring 113 and locked together with the snap ring 113.

It should be appreciated by those skilled in this art that the above embodiments are intended to be illustrative, and many modifications may be made to the above embodiments by those skilled in this art. Further, various structures described in various embodiments may be freely combined with each other without conflicting in configuration or principle. Although the disclosure has been described hereinbefore in detail with reference to the attached drawings, it should be appreciated that the disclosed embodiments in the attached drawings are intended to illustrate embodiments of the disclosure by way of example, and should not be construed as a limitation to the disclosure. Although some embodiments of the general inventive concept of the disclosure have been shown and described, it would be appreciated by those skilled in the art that changes or modification may be made to these embodiments without departing from the principles and spirit of the general inventive concept, the scope of which is defined in claims and their equivalents.

What is claimed is:

1. A connector assembly, comprising:

a first connector having a first housing and a pair of first conductive terminals disposed in the first housing, each of the first conductive terminals has a pair of first elastic terminals arranged symmetrically in a vertical direction, each pair of first elastic terminals has a pair of front ends adapted to be brought into elastic and electrical contact with a pair of first wires inserted into the first connector;

a second connector adapted to be mated with the first connector and having a second housing and a pair of second conductive terminals disposed in the second housing, each of the second conductive terminals has a rear end adapted to be brought into elastic and electrical contact with a second wire inserted into the second connector, the pair of first elastic terminals each have a rear end defining an opening therebetween adapted to receive and clamp to a front end of one of the second conductive terminals such that the rear ends of each pair of first elastic terminals is in electrical contact with the front end of one of the second conductive terminals; and wherein the first housing has a first horizontal partition wall extending only through a portion of the first housing, the first horizontal partition wall dividing only a front portion of each of the first insertion cavities into a pair of first receiving chambers arranged in the vertical direction.

2. The connector assembly of claim 1, wherein the first housing has a first vertical partition wall adapted to divide an internal space of the first housing into a pair of first insertion cavities arranged side by side in a horizontal direction.

3. The connector assembly of claim 2, wherein the pair of first conductive terminals are each inserted into one of the first insertion cavities.

4. The connector assembly of claim 3, wherein the front ends of the pair of first elastic terminals are each received in one of the first receiving chambers, with the first horizontal partition wall separating the front ends of each pair of the first elastic terminals.

5. The connector assembly of claim 4, wherein the first receiving chambers receive the first wires and the front ends of the first elastic terminals press the first wires against an inner wall of each of the first receiving chambers.

6. The connector assembly of claim 5, wherein the front ends of each of the first elastic terminals have a piercing edge piercing one of the first wires so that the first elastic terminal electrically contacts the one of the first wires.

7. The connector assembly of claim 2, wherein the second housing has a vertical positioning groove at a front portion of the second housing, the vertical positioning groove cooperating with the first vertical partition wall of the first housing.

8. The connector assembly of claim 7, wherein the vertical positioning groove divides the front portion of the second housing into a pair of plug portions arranged side by side in the horizontal direction, the plug portions of the second housing are each inserted into one of the first insertion cavities of the first housing.

9. The connector assembly of claim 8, wherein the second housing has a second vertical partition wall dividing an interior space of a rear portion of the second housing into a pair of second insertion cavities arranged side by side in the horizontal direction, the pair of second conductive terminals are each inserted into one of the second insertion cavities.

10. The connector assembly of claim 9, wherein the front ends of the second conductive terminals are each received in one of the plug portions and the rear ends of the second conductive terminals are each received in one of the second insertion cavities.

11. The connector assembly of claim 10, wherein the second insertion cavities receive the second wires and the rear ends of the second conductive terminals press the second wires against an inner wall of the second insertion cavities.

12. The connector assembly of claim 11, wherein the rear ends of each of the second conductive terminals have a piercing edge piercing one of the second wires so that the second conductive terminal electrically contacts the one of the second wires.

13. The connector assembly of claim 11, wherein the front end of each of the second conductive terminals is tongue-shaped and inserted between the rear ends of the first elastic terminals, the front end of each of the second conductive terminals is clamped by elastic deformation of the first elastic terminals acting on each side of the front end of the second conductive terminal.

14. The connector assembly of claim 1, wherein the first connector is mated with the second connector in a pluggable manner.

15. The connector assembly of claim 14, wherein the first housing is mated with the second housing in a snap-fit manner.

16. The connector assembly of claim 15, wherein a snap ring is formed on one of the first housing and the second housing and an elastic insertion tongue is formed on the other of the first housing and the second housing, the elastic insertion tongue is inserted into the snap ring and locked together with the snap ring.

17. A connector assembly, comprising:

a first connector, including:

a first housing defining an interior space, the interior space divided into two adjacent first cavities by a first vertical wall; and a first conductive terminal arranged in each of the first cavities, each first terminal including first and second elastic elements, with each elastic element defining a first wire-engaging end adapted to be brought into elastic and electrical contact with a wire inserted into the first connector, and a second clamping end; and a second connector mateable with the first connector, including:

a second housing defining an interior space, the interior space divided into two adjacent second cavities by a second vertical wall; and a second conductive terminal arranged in each of the second cavities, each second terminal defining a first wire-engaging end adapted to be brought into elastic and electrical contact with a wire inserted into the second connector, and a second mating end, the second mating end of each second terminal clamped by and directly between two second clamping ends of one of the first terminals; and wherein the first housing includes a horizontal partition wall extending only partially along a longitudinal direction of the interior space, the horizontal partition wall separating the wire-engaging ends of the first and second elastic elements of each first terminal and not extending between the second clamping ends of the first and second elastic elements of each terminal.

18. The connector assembly of claim 17, wherein the second clamping ends of the first and second elastic element of each first terminal defines a slot opening and extending in a mating direction of the first and second connectors, and the mating end of each second terminal defines an elongated tongue shape extending in the mating direction, the mating end of one second terminal received within the slot of a respective one of the first terminals with the first connector mated to the second connector.

* * * * *